US005938514A

United States Patent [19]

Amin et al.

[11] Patent Number: 5,938,514

[45] Date of Patent: Aug. 17, 1999

[54] DISK ATTACHMENT SYSTEM

[75] Inventors: Rajul N. Amin, Northborough; John P. Lefavour, Chelmsford, both of Mass.

[73] Assignee: Norton Company, Worcester, Mass.

[21] Appl. No.: 08/995,382

[22] Filed: Dec. 22, 1997

[51] Int. Cl.[6] ..... B24D 13/20

[52] U.S. Cl. ..... 451/508; 451/520

[58] Field of Search ..... 451/508, 509, 451/520, 490

[56] References Cited

U.S. PATENT DOCUMENTS

| | | | |
|---|---|---|---|
| 3,157,010 | 11/1964 | Block | 451/509 |
| 3,623,281 | 11/1971 | Moffat | 451/509 |
| 4,439,907 | 4/1984 | Block et al. | 451/490 |
| 4,839,998 | 6/1989 | Block | 451/508 |

FOREIGN PATENT DOCUMENTS

| | | | |
|---|---|---|---|
| 163448 | 10/1971 | Netherlands | 451/509 |

*Primary Examiner*—Robert A. Rose
*Attorney, Agent, or Firm*—David Bennett

[57] ABSTRACT

Rapidly releasable attachment of an abrasive disk to a rotary grinder is provided by fitting the disk with a disk retention adapter which clamps onto the disk and is provided with retention means extending from the non-abrasive bearing surface, a also providing a lock-nut assembly for mounting on the drive shaft of the rotary grinder which comprises a number of detents and detent access slots which permit the retention means to be inserted into the slots and, by a simple axial rotation move the retention means into the detents to lock the disk into position.

3 Claims, 4 Drawing Sheets

DISK ATTACHMENT SYSTEM

BACKGROUND OF THE INVENTION

This relates to a device for releasably securing abrasive disks to a backing plate which is adapted for rotational movement activated by a grinder. It is particularly useful for rapid release attachment of such abrasive disks.

In an industrial environment, especially one involving a moving production line, it is important that tools be available for use with minimum delays. Unfortunately abrasive disks wear out and need to be replaced. As a result there have been developed many quick-change devices for abrasive disks such as disks with a pressure sensitive adhesive backing which are carried on a smooth rubber backup pad and backup pads with one component of a hook and loop attachment mechanism with the other half attached to the abrasive disk.

Where the disk is more substantial and heavier it is more convenient to have the disk mechanically attached to the backup pad. One such device, which is sold by the Merit Company, requires a specially adapted backup pad, and comprises a plastic element glued to the side of the disk opposed to the abrasive bearing side. The element comprises a number of teeth projections which cooperate with apertures in the backup pad such that, when the teeth are inserted in the corresponding apertures and the disk is rotated, the teeth are retained in the apertures, thus retaining the disk on the backup pad. Such an approach is effective unless the disk is larger than about 5 inches and is subject to fairly heavy pressure during grinding. In this event the strain imposed on the adhesive junction between the plastic element and the disk is too great and can easily fail.

In another commercially available device, an abrasive disk is provided with a plate clamped to the abrasive-bearing surface and having two metal tongues projecting from the reverse side of the plate and beyond the back surface of the disk. The tongues have a portion of increased thickness. These tongues project into slots in an annular groove in a backing plate that is shaped to provide increased frictional contact with the tongues as the rotation increases. This is achieved by providing matching inclined surfaces on the tongues and an internal surface of the groove such that the tongue portion of increased thickness is retained in a rebate in the groove surface and the frictional pressure between the tongue and the groove surface with which it is in contact increases with rotation of the disk relative to the backing plate. This construction is quite effective but it places a substantial metal anchoring plate on the abrasive surface of the abrasive disk. This is not a problem when the disk is intended for use at a angle of about 45° or more to a workpiece and only the outer rim of the abrasive disk is actually used to abrade a workpiece. However for disks intended for use at a lower, flatter angle to a workpiece, the risk of contact of the metal anchoring plate with the workpiece becomes significant. In addition the rotational forces generated in use fall upon the two projecting tongues which therefore need to be very sturdy. Since these are stamped from he same piece of metal, this in turn dictates the thickness of the anchoring plate.

There is therefore a need for a quick-release, positive retention device for securing a heavy duty abrasive disk to a backup pad that can be used with abrasive disks that are designed to be used at a much flatter grinding angle than is currently used. This need is supplied by the present invention which provides a disk retention device that is able to withstand very high torque conditions without failing while remaining readily attachable and detachable with little effort.

DESCRIPTION OF THE INVENTION

The invention provides a disk retention adapter which comprises a flat plate having a centrally located mounting aperture; clamping means surrounding said aperture and projecting from a first surface of said plate, said clamping means being adapted to retain an abrasive disk between the plate and the clamping means; and at least three retention means, each having a cross-section containing an angled portion substantially parallel to the plate and projecting from a second surface of the plate opposite to the first surface. In use the retention means cooperate with a suitably shaped lock-nut having at least three detents and spaced to accomodate and retain the retention means.

The term "detent" refers to a portion of the lock-nut that is shaped to receive the retention means upon rotation of the disk retention adapter relative to the lock-nut about a common axis after the retention means has been located in a detent access slot. The retention means and the detent provide a locking or clamping combination holding both lock-nut and retention means together in a manner that is releasable by reversal of the rotation. The detent comprises a retention surface which preferably terminates in a stop surface limiting the relative rotational movement of the adapter and the lock-nut in one direction. The detent can be in the form of an enclosed slot, a rebate or shoulder in a cylindrical surface, or some other such device providing it provides a retention surface against which the retention means can bear while within the detent.

The retention means can be generally L-shaped projections spaced around the mounting aperture. Alternatively they can be in the shape of rod-shaped projections with enlarged and preferably flattened heads, (or "studs"). In either case the access slots in the cooperating lock-nut are adapted to accomodate the whole of the projections but on rotation of the adapter relative to the lock-nut, the retention means move into the cooperating detents and cannot be removed therefrom except by reversing the direction of rotation.

The invention further provides a disk attachment means comprising a disk retention adapter as described above and a lock-nut having an axial threaded bore adapted for attachment to a threaded drive spindle and a plurality of detents each comprising a retention surface and a stop surface. Located between the detents are detent access slots. These permit access to the detents and lack the retention surfaces that characterize the detents.

In use the disk retention adapter is fitted within the mounting aperture of an abrasive disk with the clamping means folded down over the abrasive bearing surface and the retention means projecting through the mounting aperture. The retention means on the disk retention adapter are inserted into the detent access slots. The disk with the attached adapter is then rotated such that the retention means move into the detent as far as the stop surface and remain in contact with at least a portion of the retention surface of the detent. The detent is preferably shaped to provide increasing frictional contact between the retention means and the retention surface as the retention means moves further into the detent and towards the stop surface. This preferably has the effect of drawing the central portion of the disk down in an axial direction such that, when presented flat to a workpiece the central portion of the disk where the clamping means are located does not contact the surface of the workpiece. Flexibility of the central portion of the disk is preferably increased by providing radial slots in the body of the disk extending from the mounting aperture outwards and located between the clamping means.

The detent access slots are understood to be spaces within the body or on the surface of the lock nut which provide access to the detents. They are therefore dictated in shape and size by the retention means that they are designed to accomodate.

The invention is also understood to provide a method of attaching an abrasive disk to a grinder which comprises:

a) providing a disk having a disk retention adapter comprising a disk shaped plate, clamping means to clamp the abrasive disk between the plate and the clamping means with the back of the disk in contact with the plate, and at least three retention means each having a cross-section containing an angled portion substantially parallel to the plate and projecting from the surface of the plate opposite to the surface in contact with the abrasive disk;

b) fitting said disk to a lock-nut mounted on a grinder drive spindle, said lock-nut having detent access slots and detents in numbers equal to the number of retention means on the disk retention adapter and similarly spaced, by inserting the retention means into the detent access slots; and c) rotating of the disk to move the retention means into the detents such that the retention means contact retention surfaces and stop surfaces within the detent such that the disk is releasably attached to the grinder.

In a preferred embodiment the detents are provided as a portion of radial extensions of the lock-nut extending away from the threaded bore of the lock-nut. The number of such extensions, and consequently of detents provided, is preferably equal to the number retention means on the disk adapter means with which they are intended to cooperate. The detent access slots in this event are the spaces between the radial extensions.

In practice the lock nut is used while located in place on the drive spindle of a grinding tool and the disk retention adapter is attached to an abrasive disk using the clamping means. Thus, in use, an abrasive disc bearing the disk retention adapter is fitted to the lock-nut which bears the detents by inserting the retention means into the detent access slots and then rotating the disk to move the retention means into the detents and towards a stop surface within the detent.

Where the disk is relatively rigid the disk can be attached directly to the lock-nut. More frequently however the disk has relatively little rigidity and is used in conjunction with a backup pad and typically this is itself also secured by the lock-nut. It is however anticipated that the lock-nut could in effect form part of the body of the backup pad such that the detent and the detent access slots are formed in the body of the backup pad/lock-nut itself.

The clamping means forming part of the disk attachment adapter is preferably a plurality of tongues projecting from the plate around the mounting aperture which are adapted to be folded down over the abrasive-bearing surface of an abrasive disk to sandwich the disk between the tongues and the plate. Alternatively the clamping means can be provided by an adhesive or by projecting teeth adapted to penetrate the disk or by a combination of the above and similar means. Yet another alternative clamping means is provided by an axial threaded extension of the plate adapted to receive a cooperating nut or nut and washer combination.

Where the clamping means has the form of projecting tongues the number of such means is preferably from 2 to 6 and most preferably 3 or 4. Such tongues are conveniently stamped from the metal of the plate such that, in part, their deformation out of the plane of the plate forms the central mounting aperture. The tongues are preferably equally spaced around the central mounting aperture.

The retention means project from the surface of the plate opposed to that bearing the clamping means and are preferably also stamped from the material of the plate for easy manufacture. Preferred retention means have a generally L-shaped cross section and a thickness corresponding to that of the plate. The distance projected below the plate should correspond to at least the distance between the retention surface of the detent and the surface of the lock-nut. The portion of the retention means bearing against the retention surface when in use is the horizontal portion of the "L" and this can project towards the circumference or towards the axis of the disk, depending on the location of the detent with which the retention means is intended to cooperate.

The portion of the retention means that is essentially parallel to the plane of the plate is wide enough to engage the retention surface of the detent and is preferably shaped to ensure that, in cooperation with the retention surface, the friction between the two increases with the distance within the detent toward the stop surface that the retention means is inserted.

In some cases it is found desirable to provide a cooperating ball and socket combination in which a bearing resiliently retained in a socket in the lock-nut retention surface cooperates with a groove in the retention means to releasably lock the retention means in position when the bearing encounters the groove. This can in effect provide the function of the stop surface.

The distance between adjacent retention means is determined by the detent access slots on the lock-nut since they are intended to fit into these slots before the disk is rotated to insert the retention means into the detents.

With respect to the disk retention adapter, the retention means are also preferably located between the clamping means, though projecting from the surface of the plate of the adapter in opposite directions. They are therefore most frequently present in the same numbers as the clamping means, though fewer or more could be provided within the same range of 2 to 6. Such an arrangement makes it possible to provide both clamping means and retention means by stamping them from the same metal disk.

The disk retention adapter is most frequently fashioned from a metal disk but this is by no means essential. If for example the clamping means is supplied by a technique that does not require bending a portion of the disk to physically entrap the disk between rigid surfaces, the adapter can be molded from a plastic material provided this has sufficient rigidity to withstand the stresses of a grinding operation.

The present invention has been described with the detents in the lock-nuts and the retention means on the adapter. It is readily appreciated however that the invention would be essentially equivalent if the location of the detents was on the adapter and the retention means were part of the lock-nut. It is intended that all such obvious variations should be embraced by the present invention.

DESCRIPTION OF PREFERRED EMBODIMENTS

Figure 1:
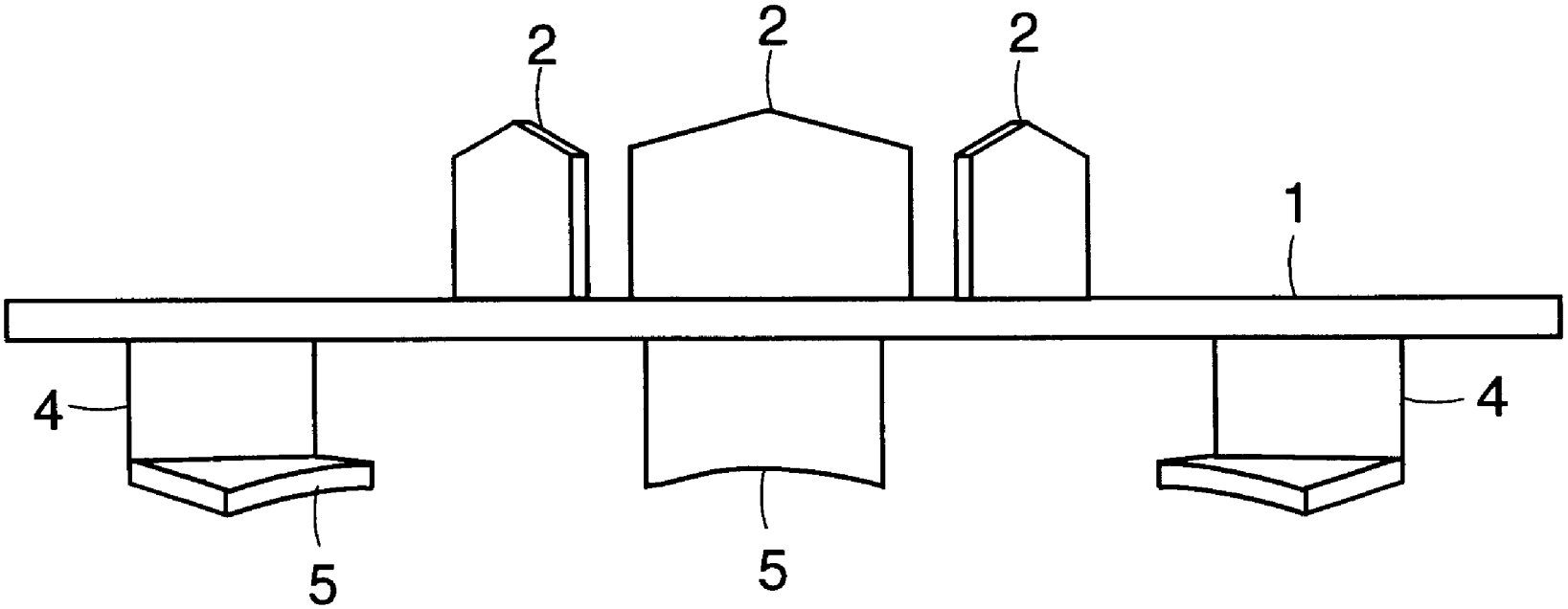
FIG. 1 illustrates a side view of a disk retention adapter according to the invention.

The invention is now described with particular reference to the embodiments described in the Drawings which are understood to be for the purposes of illustration only and do not imply any necessary limitation in the scope of the invention.

Figure 2B:
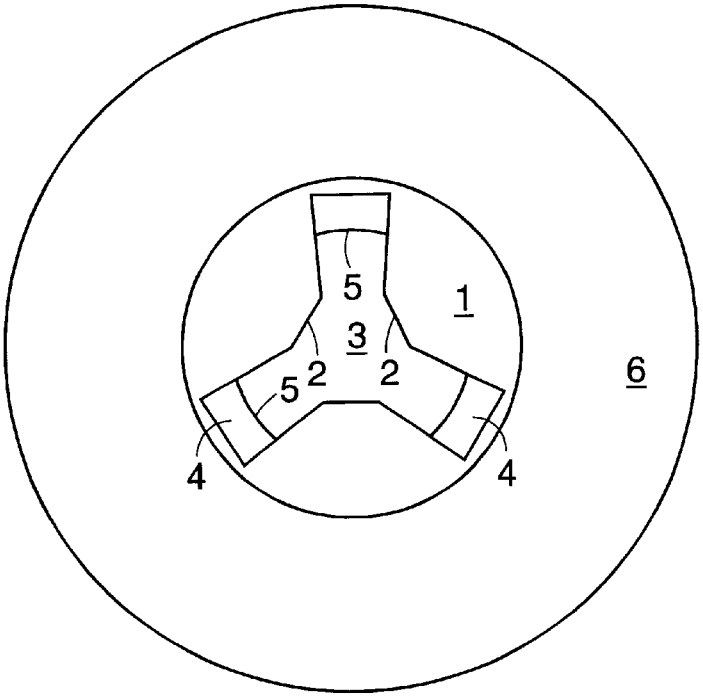
FIGS. 2*a* and 2*b* illustrate top and bottom sides respectively of a disk with the disk retention device illustrated in FIG. 1 in place.
Figure 2A:
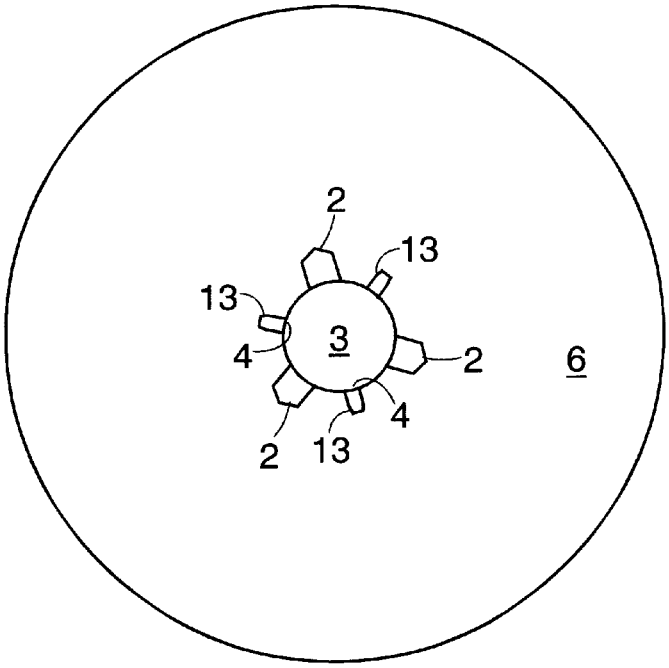

In the drawings a disk retention adapter comprises a metal plate, 1, having a central mounting aperture, 3, and punched out from the metal of the plate, three tongues, 2, which, when the disk is in place, are bent down to sandwich the disk between the tongues and the plate as shown in FIG. 2*a*. Also punched out of the metal of the plate are three retention means, 4, with L-shaped cross-sections with the portion parallel to the plate having a centrally located deformation, 5, in the direction of the plane of the plate. FIG. 2*b* shows the reverse side of the abrasive disk with attached adapter that is shown in FIG. 2*a* and illustrates the location of the retention means. This view also shows radial slots, 13, cut into the abrasive disk and intended to increase the flexibility of the central portion of the abrasive disk. These slots increase the ease with which this central portion can be deformed axially when the disk is attached by the adapter to the lock-nut and rotated to lock the disk in place.

Figure 3B:
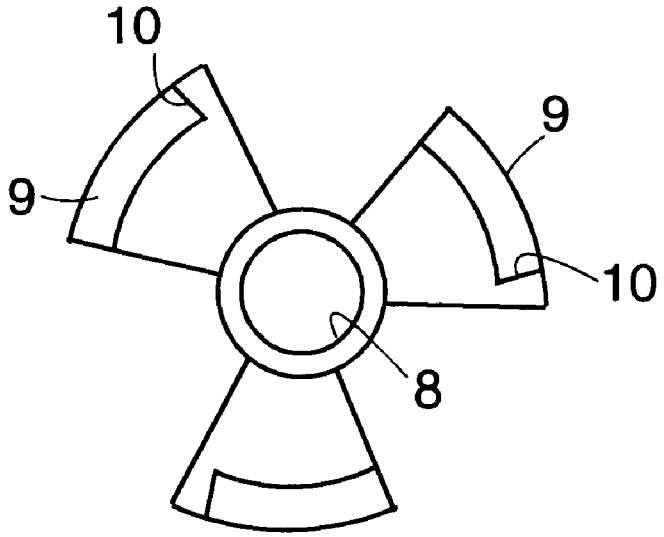
FIGS. 3*a* and 3*b* illustrate top and bottom surfaces respectively of a lock-nut according to the invention
Figure 3A:
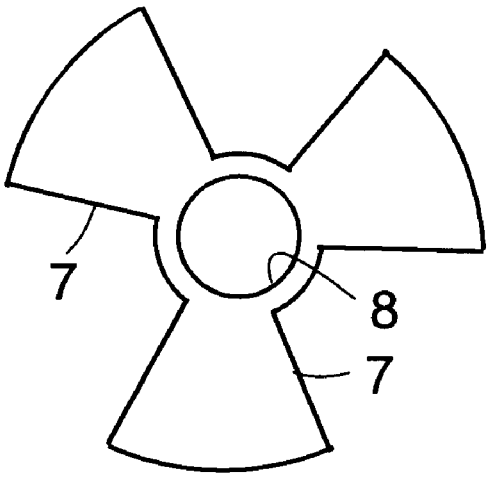

FIG. 3 illustrates a lock-nut designed to cooperate with the disk attachment means illustrated in FIGS. 1 and 2 which has the form of a nut with a threaded bore, 8, and three radial extensions, 7. The spaces between the radial extensions provide the detent access slots. The face of the lock-nut illustrated in FIG. 3*a* contacts the disk and the disk retention adapter when in use. The opposed face of the lock-nut shown in FIG. 3*b* has detents each comprising a retention surface, 9, and a stop surface, 10.

Figure 4:
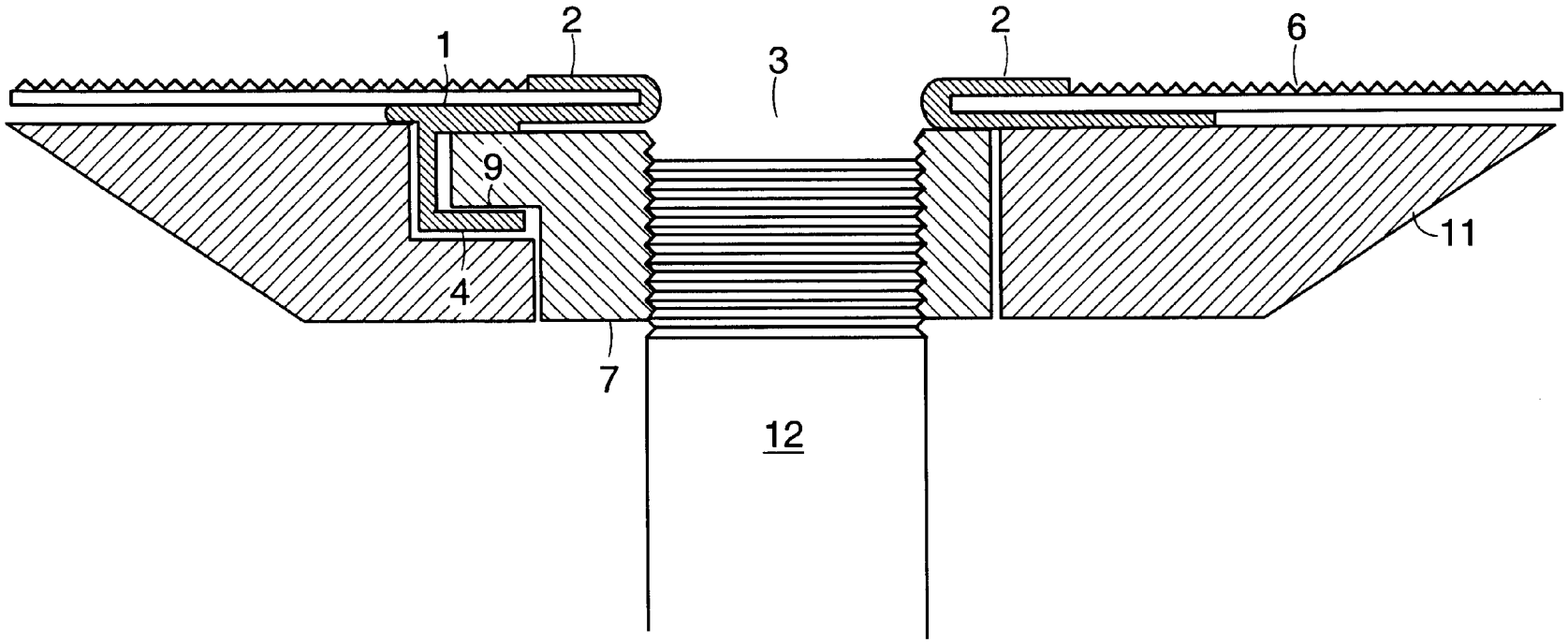
FIG. 4 is a cross-section of the disk retention means and the lock-nut cooperating to hold an abrasive disk in place.

FIG. 4 illustrates in cross-section an abrasive disk, 6, clamped between clamping means 2 and the surface of a disk, 1, which provides the body of the disk retention adapter. A lock-nut having a threaded bore, 8, is mounted on a rotatable spindle 12 and retained within a backup pad, 11. The lock-nut has a detent comprising a retention surface, 9, located on a radial extension, 7, of the lock-nut.

In us e the disk bearing the disk retention adapter is placed in contact with the lock-nut with the retention means located in the gaps between the radial extensions on the lock-nut, (or detent access slots). From that position a simple clockwise rotation of the disk moves the retention means into the detents. The deformation, 5, in the retention means ensures that the deformation will bear against the retention surface and cause an increased degree of frictional resistance to relative movement once the retention means is more than part way inserted into the detent.

As indicated above the lock-nut could in effect be part of a backup pad and in such event the retention means on the disk retention adapter could be configured to bend outwardly rather than inwardly as shown in the drawings and to cooperate with a detent in the backup pad portion of the lock-nut/backup pad combination. In this event the radial extensions on the lock-nut would not be required and the mounting function would be provided by a threaded bore inside the backup pad. This could be actually part of the body of the backup pad or a suitable threaded insert axially located within the backup pad. In either event, in such an arrangement the whole backup pad would provide the function of, and for the purposes of this invention would become in effect, the lock-nut.

Where the abrasive disk has a configuration with features that, in use, require that the disk assume a specific configuration with respect to a backup pad, the positions of the retention means and the stop surface in the detent are preferably located such that, when the retention means is inserted fully into the detent with one edge in register with the stop surface, the alignment of disk and backup pad is perfect.

What is claimed is:

1. An abrasive disk attachment system which comprises:

a) a disk retention adapter comprising a flat plate having a centrally located mounting aperture; clamping means surrounding said aperture and projecting from a first surface of said plate and adapted to retain an abrasive disk, said disk having an abrasive bearing surface and an opposed non-abrasive bearing surface, between the plate and the clamping means with the plate in contact with the non-abrasive bearing surface of the disk; and at least three retention means each having a cross-section of which at least a part is parallel to but axially removed from the plate of the adapter, said retention means projecting from a second surface of the plate opposite to the first surface which is in contact with the abrasive disk; and b) a lock-nut having an axial threaded bore adapted for attachment to a threaded drive spindle and a plurality of detents comprising a retention surface and, located between the detents, detent access slots;

the location and number of detents and detent access slots being such as would permit insertion of the retention means on the disk retention adapter into the detent access slots of the lock-nut and axial rotation of the adapter to move the retention means into the detents and into contact with a cooperating retention surface until a stop surface is reached.

2. An abrasive disk attachment system according to claim 1 in which the numbers of retention means, detents and detent access slots are each the same and from 3 to 8.

3. An abrasive disk attachment system according to claim 1 in which the retention means and the retention surface are shaped to provide that, as the retention means moves into the detent, the friction between the two increases.

* * * * *